US006148520A

United States Patent [19]

Berns

[11] Patent Number: 6,148,520

[45] Date of Patent: Nov. 21, 2000

[54] BOX CUTTER WITH AUTORETRACTING BLADE

[75] Inventor: Harald Berns, Wuppertal, Germany

[73] Assignee: Martor-Argentax E.H. Beermann KG, Solingen, Germany

[21] Appl. No.: 09/088,927

[22] Filed: Jun. 2, 1998

[30] Foreign Application Priority Data

Jun. 4, 1997 [DE] Germany ..... 197 23 279

[51] Int. Cl.[7] ..... B67B 7/00

[52] U.S. Cl. ..... 30/2; 30/162; 30/335

[58] Field of Search ..... 30/2, 162, 335

[56] References Cited

U.S. PATENT DOCUMENTS

| | | | |
|---|---|---|---|
| 3,999,290 | 12/1976 | Wood | 30/2 |
| 5,384,963 | 1/1995 | Beermann | 30/162 |
| 5,581,890 | 12/1996 | Schmidt | 30/162 |
| 5,617,635 | 4/1997 | Berns | 30/162 |
| 5,813,121 | 9/1998 | Gringer | 30/162 |

FOREIGN PATENT DOCUMENTS 36 22 342 1/1988 Germany .

*Primary Examiner*—Lee Young
*Assistant Examiner*—Kevin G. Vereene
*Attorney, Agent, or Firm*—Herbert Dubno; Andrew Wilford

[57] ABSTRACT

A knife has a housing and a blade slide carrying a blade and displaceable longitudinally in the housing between a rear retracted end position with the blade wholly received in the housing and a front extended end position with the blade extending forward from the housing and through an intermediate position. A spring urges the blade slide continuously rearward into the retracted position. An actuator slide is displaceable in the housing independently of the blade slide between a front end position and a rear end position and through an intermediate position and is provided with an externally accessible actuating formation. Another spring urges the actuator slide continuously into the rear position. A seat member on one of the slides is displaceable along a path on movement of the one slide between its end positions and a coupling member on the other of the slides is engageable in the seat member on forward movement of the actuator slide from its rear position into the intermediate position of the actuator slide for pushing the blade slide forward from its rear retracted position to its intermediate position on displacement of the actuator slide from its intermediate position to its front position. The members are disengaged from each other and the coupling member is displaced out of the path of the seat member on displacement of the blade from its intermediate position into its extended position.

20 Claims, 4 Drawing Sheets

13
14
15
16
17
18
19
20
21
22
23
24
25
26
27
28
29
30
31
34
35
36
37
38
39
40
44
45
47
48
M
R
C
Z
X 13
14
15
16
17
18
19
20
21
22
23
24
25
26
27
28
30
31
32
33
34
35
36
37
38
39
40
44
45
47
LN
M
R
C
Z
X

BOX CUTTER WITH AUTORETRACTING BLADE

FIELD OF THE INVENTION

The present invention relates to a razor knife. More particularly this invention concerns a so-called box cutter that is used to open cartons and whose blade automatically retracts.

BACKGROUND OF THE INVENTION

A standard box cutter as described in German patent 3,622,342 has a housing in which a blade secured in a blade holder or slide can move longitudinally. A laterally projecting pusher button projects from the slide and is actuated by the user's thumb to extend the blade from the housing. A tension spring connected between the blade slide and the housing continuously urges the blade back into a retracted position in the housing.

Thus to use this knife the user pushes forward the blade slide with his or her thumb to extend the blade and engages the blade in the item being cut. Normally the friction of the blade against the workpiece is sufficient to overcome the spring force so that, once the blade is actually cutting, the user can release the blade holder and the blade will remain in the extended position. Once the blade is pulled out of the workpiece it will snap back into the retracted position so the knife can be pocketed without danger.

The problem with such a system is that the user frequently maintains his or her thumb on the button as the knife is used, normally because the knife is used immediately on the workpiece when the blade is extended and the user has no reason to change his or her grip. Thus if the button is not released, a subsequent attempt to pocket the knife, for instance, can result in injury.

OBJECTS OF THE INVENTION

It is therefore an object of the present invention to provide an improved box knife with an autoretracting blade.

Another object is the provision of such an improved box knife with an autoretracting blade which overcomes the above-given disadvantages, that is which is safer to use than the above-described type of knife.

SUMMARY OF THE INVENTION

A knife has according to the invention a housing and a blade slide carrying a blade and displaceable longitudinally in the housing between a rear retracted end position with the blade wholly received in the housing and a front extended end position with the blade extending forward from the housing and through an intermediate position. A spring urges the blade slide continuously rearward into the retracted position. An actuator slide is displaceable in the housing independently of the blade slide between a front end position and a rear end position and through an intermediate position and is provided with an externally accessible actuating formation. Another spring urges the actuator slide continuously into the rear position. A seat member on one of the slides is displaceable along a path on movement of the one slide between its end positions and a coupling member on the other of the slides is engageable in the seat member on forward movement of the actuator slide from its rear position into the intermediate position of the actuator slide for pushing the blade slide forward from its rear retracted position to its intermediate position on displacement of the actuator slide from its intermediate position to its front position. The members are disengaged from each other and the coupling member is displaced out of the path of the seat member on displacement of the blade from its intermediate position into its extended position.

Thus with this system the actuator slide is pushed from its rear position into its forward position to move the blade slide from its rear position into its intermediate position. When the blade is then engaged in a workpiece and, as is usual, rearward traction is applied to the knife to cut the workpiece with the blade, the blade is pulled into its forward position. This causes the coupling member to disengage itself from the seat member and move out of its path. When subsequently the blade is freed from the workpiece, its spring will pull it back into the retracted position even if the actuator slide remains in the front actuated position. Thus the blade can be extended, but once engaged in a workpiece will always automatically retract as soon as it is disengaged from the workpiece.

According to the invention the decoupling system includes guides displacing the actuator and blade slides apart on forward movement from the rear positions. More particularly a stop arrests forward movement of the actuator slide when it reaches its front position. The guides are formed in the housing and include at least one groove extending at a small acute angle to the path and an entrainment element extending laterally from the other of the slides and engaged in the groove. The groove is formed in the housing and the entrainment element is a projection formed on the actuator slide and riding in the groove. Normally the housing is formed with two such grooves parallel to each other and the entrainment element is a pair of such projections engaged in the respective grooves. It is also within the scope of this invention for the actuator slide to move along a non-straight or curved path relative to the rectilinearly moving blade slide, or vice versa.

The coupling member according to the invention is a longitudinally extending and laterally elastically deflectable member having a base fixed on the other member. The seat member forms a seat directed toward the deflectable member and receiving the free end thereof on forward displacement of the actuating member from its rear position. The deflectable member is a spring, normally made of spring steel. It can also be unitarily formed of plastic with the other member.

The other slide can be the blade slide and the one slide the actuator slide or vice versa. Either way the seat is a rearwardly open pocket and the deflectable member extends forward from its base to its free end.

For a compact assembly the actuator slide is of C-section and surrounds the blade slide. Both slides are made of plastic. The springs according to the invention are completely independent of each other.

The housing in accordance with the invention is formed with an aperture and the actuating formation is a laterally projecting button accessible through the aperture.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
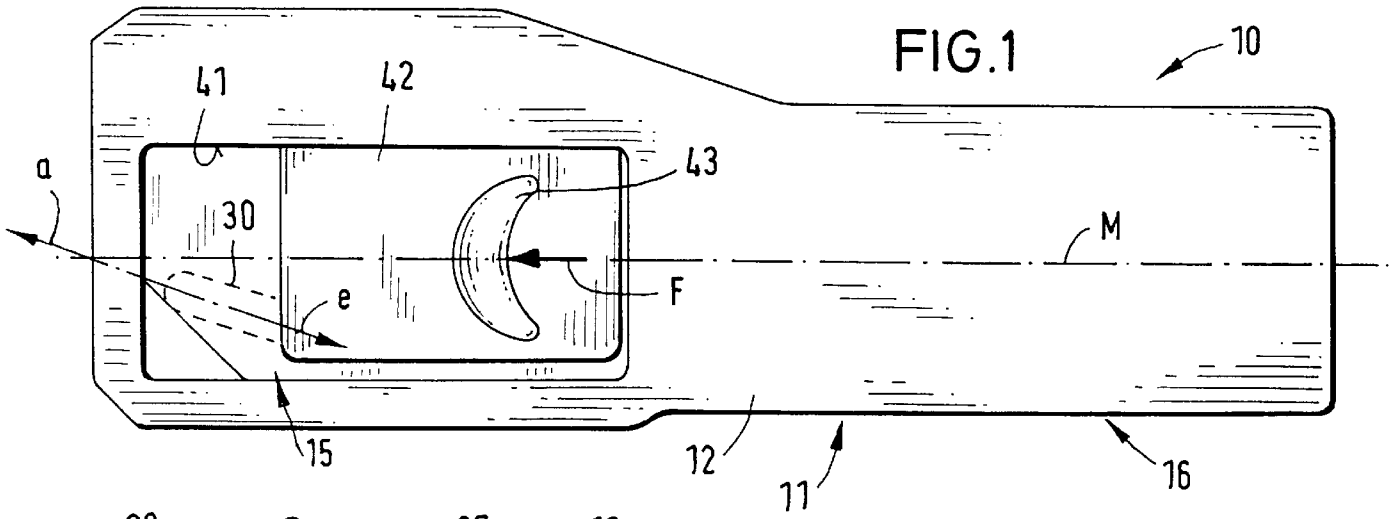
FIG. 1 is a side view of the knife according to the invention.
Figure 2:
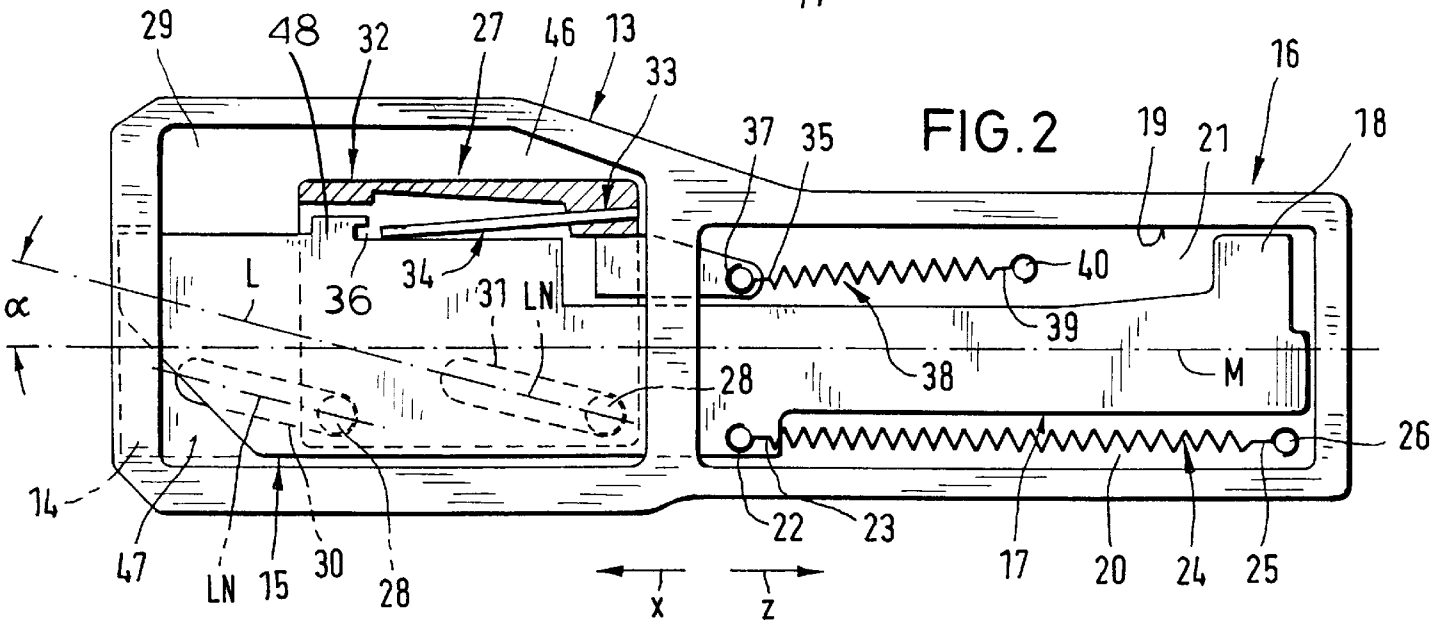
FIG. 2 is a partly sectional side view of the FIG. 1 knife with half the housing removed.
Figure 3:
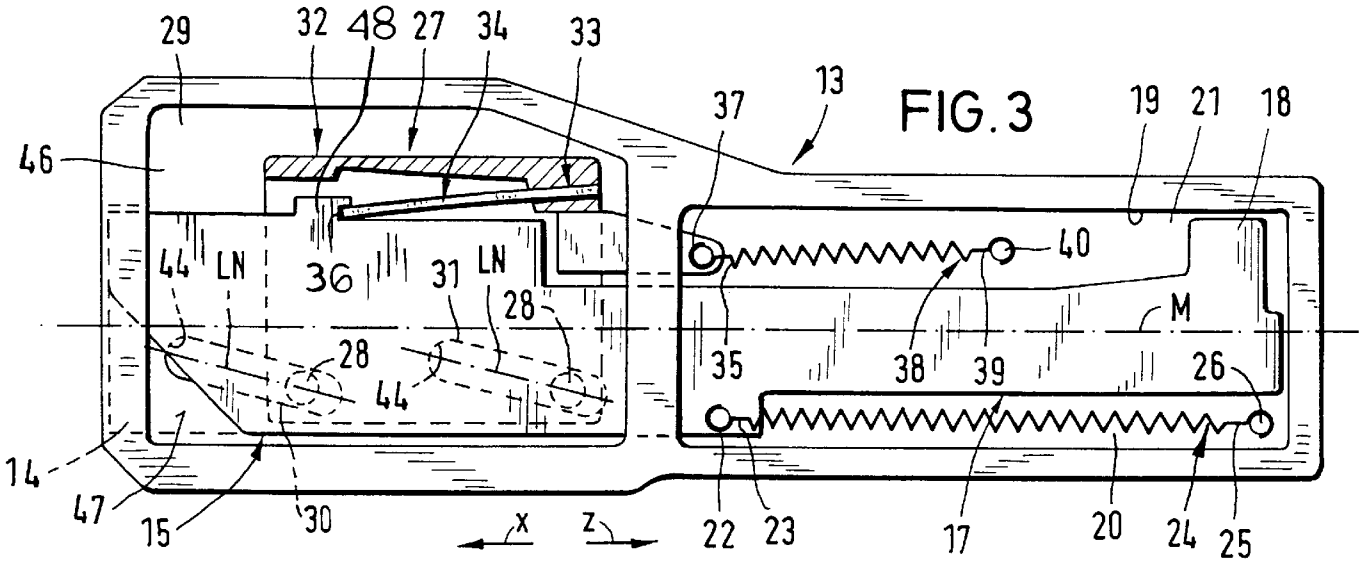
FIG. 3 is a view like FIG. 2 but showing the knife on initial actuation of the blade slide.
Figure 4:
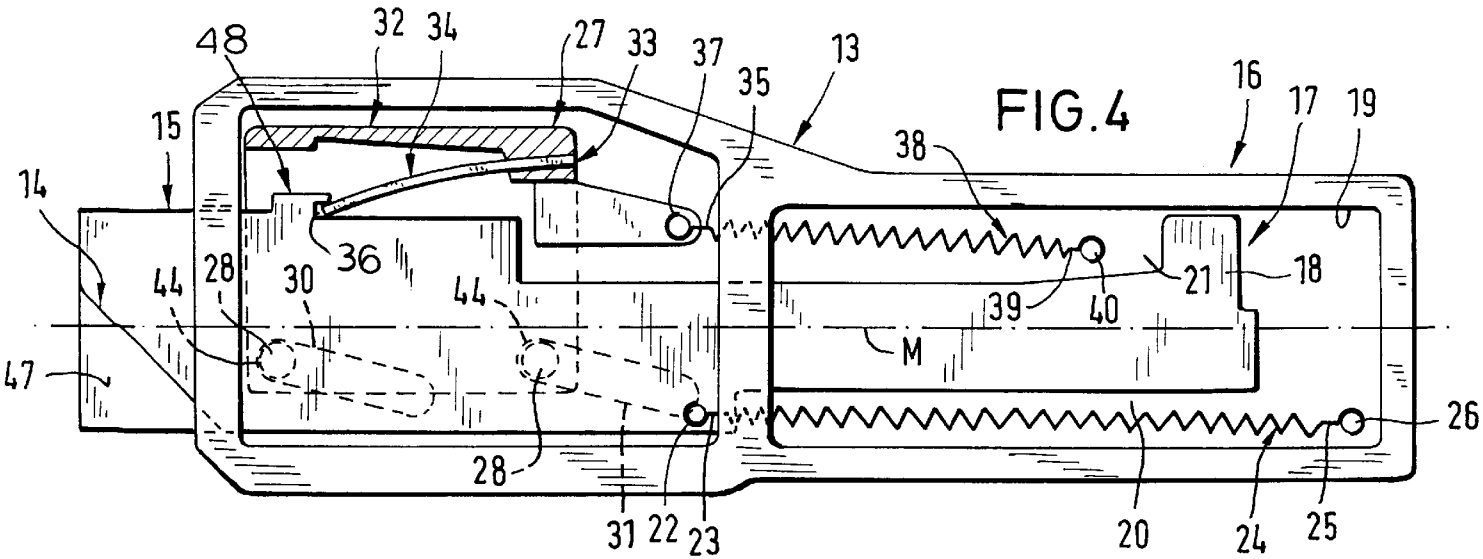
FIG. 4 is a view like FIG. 2 but showing the knife as the blade is extended but before the blade engages in a workpiece.
Figure 5:
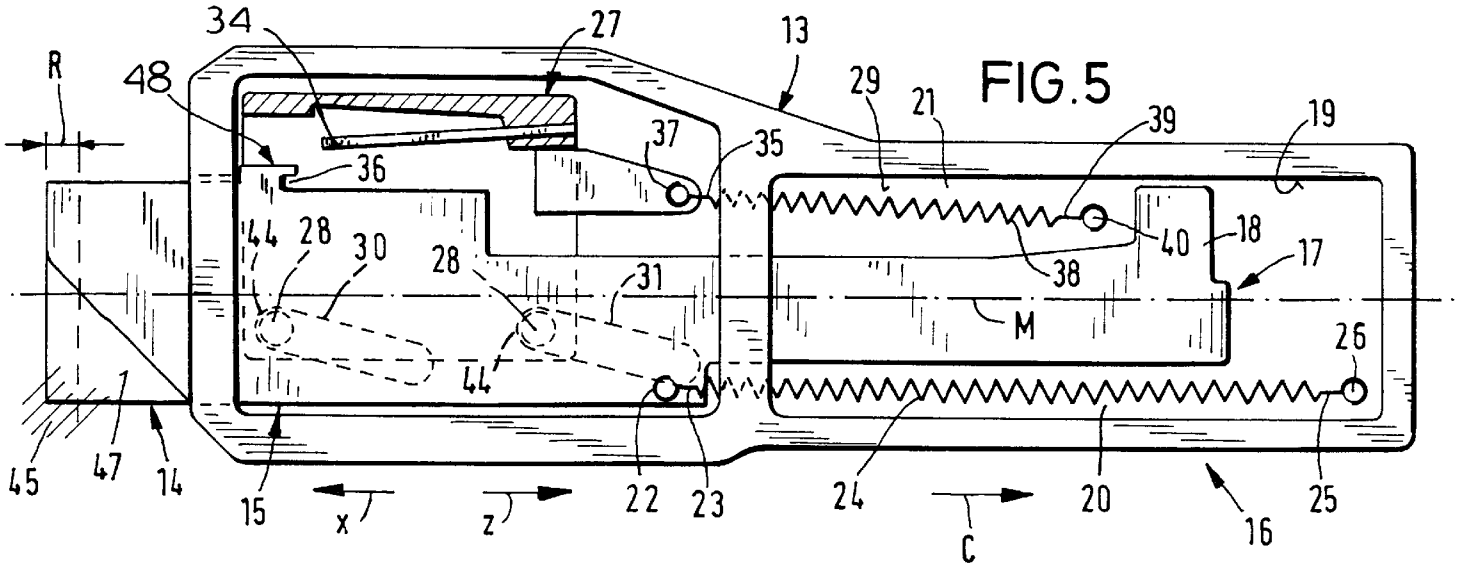
FIG. 5 is a view like FIG. 2 but showing the knife in use with the blade engaged in a workpiece and the blade slide still in the actuated position.

As seen in FIGS. 1 and 2 a box-cutter knife 10 according to the invention has a housing 11 formed by a pair of molded plastic housing parts 12 and 13 that fit together to form a cavity 46. A blade 14 held in a molded plastic blade slide 15 is displaceable along an axis M in an outward or forward direction x into a fully extended position (FIG. 6) and in an opposite inward or rearward direction z into a retracted position (FIGS. 1, 2, 3, and 7) and through an intermediate position (FIGS. 4 and 5). In the intermediate and extended positions an exposed corner 47 of the blade 14 can be engaged with a workpiece 45 (FIGS. 5 and 6) to cut it.

The blade slide 15 has a rear end 17 housed in a handle part 16 of the housing 11 and formed with a lateral extension 18 riding on an inside guide surface 19 of the parts 12 and 13. This rear slide end 17 is cut away on its opposite sides at 20 and 21. The cutout 20 holds a tension spring 24 having a front end 23 hooked in a pin or eye 22 formed in the slide 15 at its middle and a rear end 25 hooked around an anchor pin 26 formed at the rear end of the housing part 13.

A molded plastic actuator slide 27 can move in the housing 11 underneath the slide 15 in a direction L forming a small acute angle a with the axis M, outward or forward irk a direction a into a front position (FIGS. 4, 5, and 7) and inward or rearward in a direction e into a rear position (FIGS. 1, 2, 3, and 6), like the slide 15 along the axis M in the directions x and z. The bottom face of the actuator slide 27 is formed with two parallel laterally projecting pins 28 that engage in respective angled grooves 30 and 31 formed in the inside wall 29 of the bottom housing part 13. The grooves 30 and 31 have axes LN that extend parallel to the direction M and in fact define this direction M in that the sliding engagement of the pins 28 in the grooves 30 and 31 constrains the actuator slide 27 to move only in the direction M.

The slide 27 has a lateral projection 32 holding a rear end 33 of a stiff spring-steel arm 34 forming a coupling member that can engage in a notch 36 formed in a lateral projection or seat member 48 of the slide 15. A tension spring 38 accommodated in the cutout 21 of the rear extension 17 has a front end 35 hooked at 37 to the slide 27 and a rear end 39 hooked around an anchor pin 40 formed on the housing part 13 adjacent its rear end. Thus this spring 38 continuously urges the slide 27 back-ward in the direction z.

A cutout 41 in the top cover part 12 exposes a pusher button 42 having a thumb seat 43 and unitarily formed with the actuator slide 27. To this end the slide 27 is of C-section, engaged around three sides of the slide 15 and is unitarily formed of a durable plastic with this button 42.

The knife 1 is operated as follows:

Under normal circumstances the parts are in the position of FIGS. 1 and 2, with the two slides in their rearmost positions and the blade 14 wholly retracted into the housing 11. In this position the knife 10 can be safely handled or carried in a pocket.

For use the user applies a forward force F on the thumb seat 43 to push the actuator slide 27 forward. This action as shown in FIG. 3 first catches the front end of the entrainment spring 34 in the notch or seat 36 of the table 48 of the blade slide 15.

On further forward movement of the slide 27 in direction a as shown in FIG. 4 the spring 34 pushes the slide 15 forward in the direction x. Due to movement of the slide 27 in direction L, which forms the small acute angle a with the direction M along which the slide 15 moves, this action causes the spring 34 to bend, without however disconnecting the slides 15 and 27 from each other, until the pins 28 reach front stop ends 44 of the slots 30 and 31. In this position the blade 14 is extended from the housing 11 in the intermediate position of the slide 15.

On engagement of the blade end 47 in a workpiece 45 as shown in FIG. 5, the friction between the blade 14 and this workpiece 45 as the blade 14 is drawn backward in direction C to cut the workpiece 45 will pull the blade 14 and its holder 15 out a short distance R into the front end position. Such movement will disconnect the coupling formation 48 from the spring 34, allowing its end to snap out of the seat 36 and move out of longitudinal alignment with the formation 48. Cutting can progress with the friction of the blade 14 in the workpiece 45 holding the blade 14 in the FIG. 5 extended position.

Figure 6:
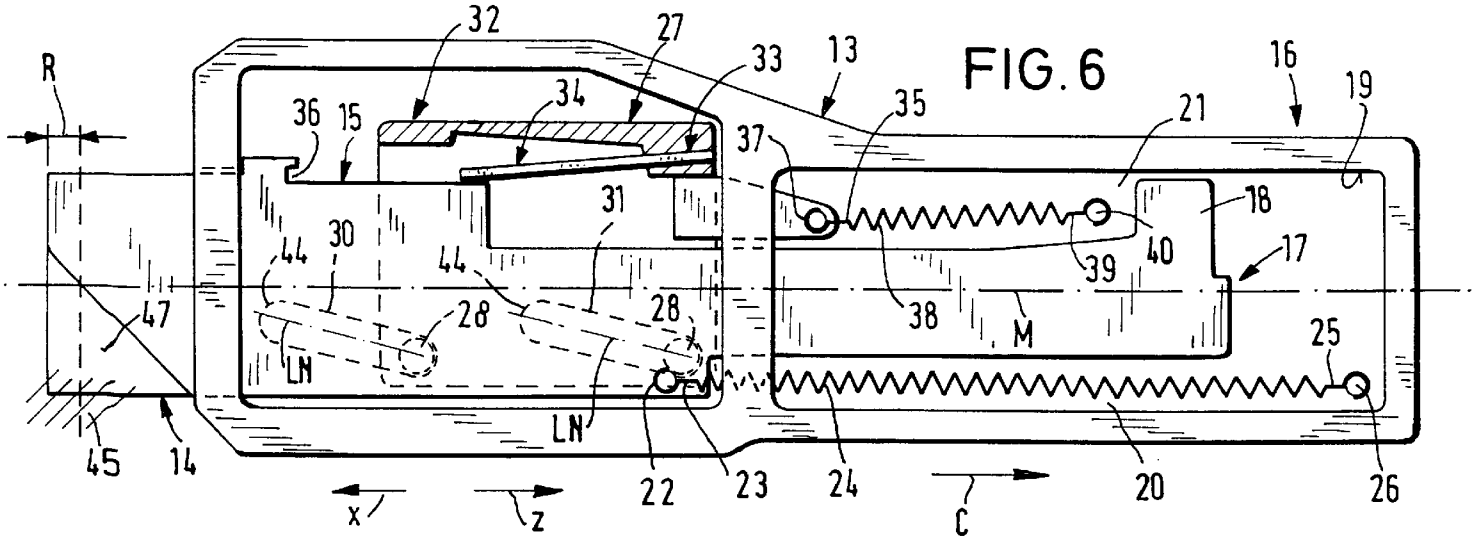
FIG. 6 is a view like FIG. 5 but with the blade slide released.

In this position if the actuator slide 27 is released it will snap back as shown in FIG. 6 into its rear unactuated position. Meanwhile, however, the friction of the blade 14 in the workpiece 45 will maintain the blade 14 extended. Of course if the blade 14 is pulled out of the workpiece 45, it will snap back into the position of FIG. 2 due to the action of the spring 24.

Figure 7:
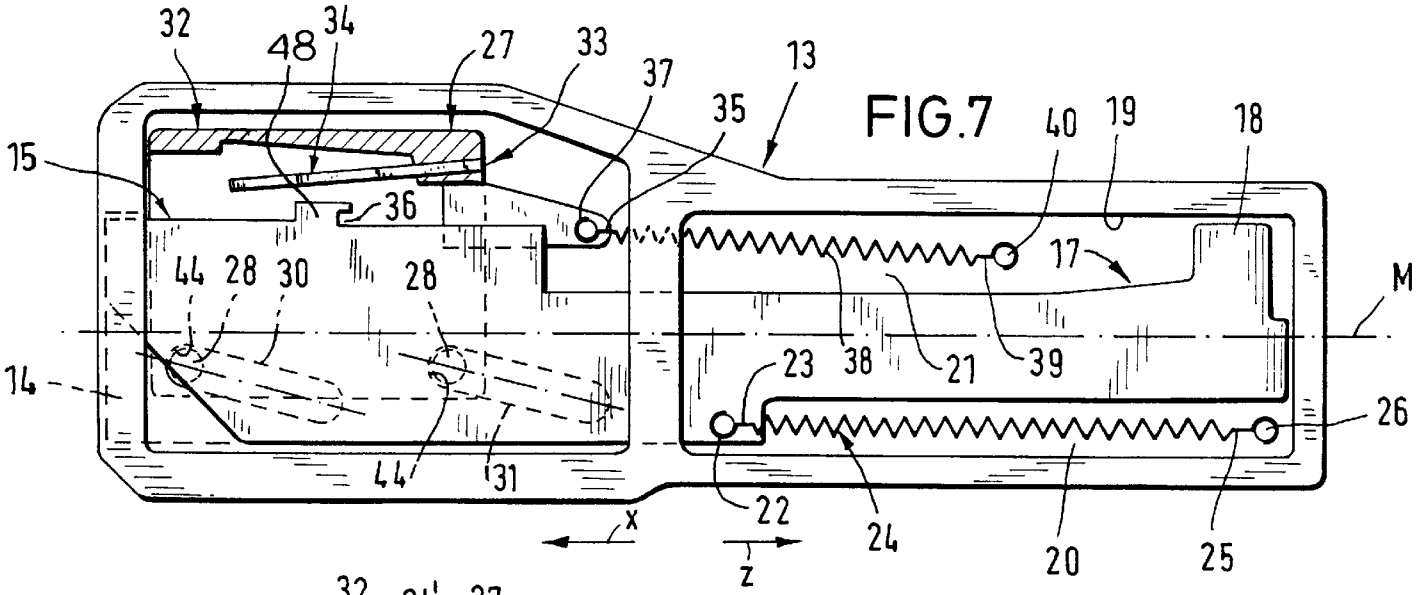
FIG. 7 is a view like FIG. 5 but with the blade not engaged in the workpiece and retracted.

On the other hand if in the position of FIG. 5 the user keeps his or her thumb on the button 42, holding the actuator slide 27 in its forward actuated position, the blade 14 is still free to snap back into the housing 11 if it is disengaged from the workpiece 45 as shown in FIG. 7. In other words the slide 27 must be actuated to extend the blade 14, but once the blade 14 is engaged in the workpiece 45, whether or not the slide 27 is actuated is irrelevant with respect to return of the blade 14 to the retracted position. The user can safely, for instance, pocket the knife 10 without taking his or her thumb off the button 42.

Figure 8:
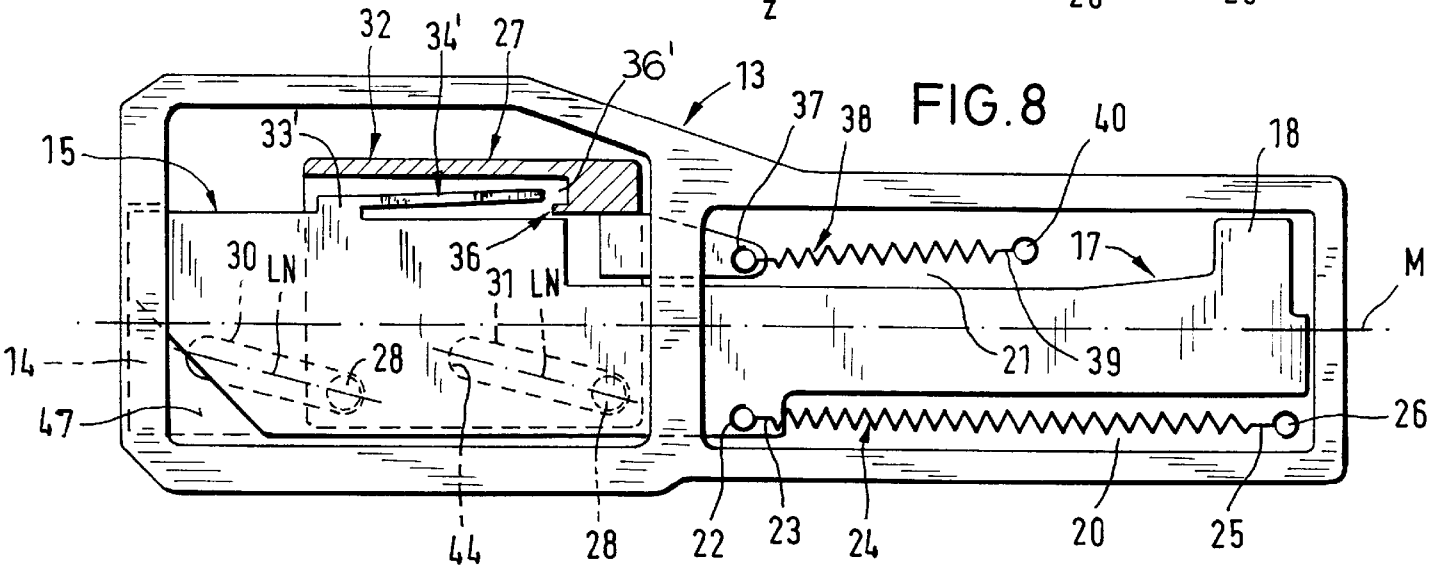
FIG. 8 is a view like FIG. 2 of an alternative system.

FIG. 8 shown an alternative arrangement where the slide 27 is formed with the seat or pocket 36' and the entrainment member 34' has its base 33' mounted on the blade holder 15. In fact the entrainment formation 34' here is unitarily formed of plastic with the slide 15.

I claim:

1. A knife comprising:

a housing;

a blade slide carrying a blade and displaceable longitudinally in the housing between a rear retracted end position with the blade wholly received in the housing and a front extended end position with the blade extending forward from the housing and through an intermediate position;

a blade spring urging the blade slide continuously rearward into the retracted position;

an actuator slide displaceable longitudinally in the housing independently of the blade slide between a front end position and a rear end position and through an intermediate position and provided with an externally accessible actuating formation;

an actuator spring urging the actuator slide continuously into the respective rear position;

a seat member on one of the slides and displaceable along a path on movement of the one slide between its end positions;

means including a coupling member on the other of the slides engageable in the seat member on forward movement of the actuator slide from its rear position into its intermediate position for pushing the blade slide forward from its rear retracted position to its intermediate position on displacement of the actuator slide from its intermediate position to its front position; and decoupling means connected to the coupling member for disengaging the members from each other and displacement of the coupling member transversely out of the path of the seat member on displacement of the blade from its intermediate position into its extended position.

2. A knife comprising:

a housing;

a blade slide carrying a blade and displaceable longitudinally in the housing between a rear retracted end position with the blade wholly received in the housing and a front extended end position with the blade extending forward from the housing and through an intermediate position;

a blade spring urging the blade slide continuously rearward into the retracted position;

an actuator slide displaceable in the housing independently of the blade slide between a front end position and a rear end position and through an intermediate position and provided with an externally accessible actuating formation;

an actuator spring urging the actuator slide continuously into the respective rear position;

a seat member on one of the slides and displaceable along a path on movement of the one slide between its end positions;

means including a coupling member on the other of the slides engageable in the seat member on forward movement of the actuator slide from its rear position into its intermediate position for pushing the blade slide forward from its rear retracted position to its intermediate position on displacement of the actuator slide from its intermediate position to its front position; and decoupling means connected to the coupling member for disengaging the members from each other and displacement of the coupling member out of the Path of the seat member on displacement of the blade from its intermediate position into its extended position, the decoupling means including guides displacing the actuator and blade slides apart on forward movement from the rear positions.

3. The knife defined in claim 2, further comprising means including a stop arresting forward movement of the actuator slide when it reaches its front position.

4. The knife defined in claim 2 wherein the guides are formed in the housing.

5. The knife defined in claim 4 wherein the guides include at least one groove extending at a small acute angle to the path and an entrainment element extending laterally from the other of the slides and engaged in the groove.

6. The knife defined in claim 5 wherein the groove is formed in the housing and the entrainment element is a projection formed on the actuator slide and riding in the groove.

7. The knife defined in claim 5 wherein the housing is formed with two such grooves parallel to each other and the entrainment element is a pair of such projections engaged in the respective grooves.

8. The knife defined in claim 2 wherein the coupling member is a longitudinally extending and laterally elastically deflectable member having a base fixed on the other slide.

9. The knife defined in claim 8 wherein the seat member forms a seat directed toward the deflectable member and receiving the free end thereof on forward displacement of the actuating member from its rear position.

10. The knife defined in claim 9 wherein the deflectable member is a spring.

11. The knife defined in claim 10 wherein the spring is unitarily formed with the other member.

12. The knife defined in claim 9 wherein the other slide is the blade slide and the one slide is the actuator slide.

13. The knife defined in claim 9 wherein the other slide is the actuator slide and the one slide is the blade slide.

14. The knife defined in claim 9 wherein the seat is a rearwardly open pocket, the deflectable member extending forward from its base to its free end.

15. The knife defined in claim 9 wherein the deflectable member is made of spring steel.

16. The knife defined in claim 9 wherein the actuator slide is of C-section and surrounds the blade slide.

17. The knife defined in claim 1 wherein both slides are made of plastic.

18. The knife defined in claim 1 wherein the springs are completely independent of each other.

19. The knife defined in claim 1 wherein the housing is formed with an aperture and the actuating formation is a laterally projecting button accessible through the aperture.

20. The knife defined in claim 1 wherein the coupling member is a laterally deflectable spring elongated generally parallel to the path and bearing laterally elastically against the one slide, the decoupling means including respective guides moving the slides laterally apart on forward movement from their rear positions.

* * * * *